US007880871B2

(12) United States Patent
Kazama et al.

(10) Patent No.: US 7,880,871 B2
(45) Date of Patent: Feb. 1, 2011

(54) RECORDING SHEET MOVING DEVICE, IMAGE FORMING DEVICE, AND RECORDING SHEET MOVING METHOD

(75) Inventors: Toshiyuki Kazama, Ebina (JP); Michio Tada, Ebina (JP); Ryoji Watanabe, Ebina (JP); Shouichi Maeda, Ebina (JP); Makoto Ochiai, Iwatsuki (JP); Tatsunori Izawa, Ebina (JP); Naoto Nishi, Ebina (JP); Yoshinobu Nakamura, Ebina (JP); Satoshi Kanou, Ebina (JP); Shun Yashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 223 days.

(21) Appl. No.: 12/336,065

(22) Filed: Dec. 16, 2008

(65) Prior Publication Data

US 2009/0256308 A1 Oct. 15, 2009

(30) Foreign Application Priority Data

Apr. 11, 2008 (JP) ..... 2008-103885

(51) Int. Cl.
*G01B 3/36* (2006.01)

(52) U.S. Cl. ..... 356/139.04

(58) Field of Classification Search ..... 356/3.01–3.15, 356/4.01–4.1, 5.01–5.15, 6–22, 28, 28.5, 356/139.01–139.1
See application file for complete search history.

(56) References Cited

U.S. PATENT DOCUMENTS

| | | | | |
|---|---|---|---|---|
| 6,741,831 | B2 | 5/2004 | Seto | 399/388 |
| 7,571,908 | B2 | 8/2009 | Inui et al. | 271/251 |
| 2007/0046713 | A1 * | 3/2007 | Miyahara et al. | 347/19 |
| 2008/0024808 | A1 | 1/2008 | Masuda | 358/1.12 |
| 2008/0124163 | A1 | 5/2008 | Morimoto et al. | 400/630 |
| 2009/0267292 | A1 | 10/2009 | Inui et al. | 271/229 |

FOREIGN PATENT DOCUMENTS

| | | |
|---|---|---|
| JP | 11-189355 | 7/1999 |
| JP | 2003-263090 A | 9/2003 |
| JP | 2005-206338 | 8/2005 |
| JP | 2006-96473 A | 4/2006 |
| JP | 2007-261716 A | 10/2007 |
| JP | 2008-32913 A | 2/2008 |
| JP | 2008-127193 | 6/2008 |
| JP | 20080-127194 A | 6/2008 |
| JP | 2008-233441 | 10/2008 |

* cited by examiner

*Primary Examiner*—Thomas H Tarcza
*Assistant Examiner*—Luke D Ratcliffe
(74) *Attorney, Agent, or Firm*—Morgan, Lewis & Bockius LLP

(57) ABSTRACT

A recording sheet moving device includes: a moving unit that moves a recording sheet; a recording sheet specifying unit that specifies a length in the transport direction and a weight per unit area of the recording sheet; a first memory configured to record, for each of plural recording sheets, a threshold for a length in the transport direction in association with a weight per unit area; and a movement control unit that retrieves a threshold for a length on the basis of the specified weight per unit area from the first memory, and compares the retrieved threshold for a length and the specified length, to determine whether to cause the moving unit to move the recording sheet, and if it is determined that the recording sheet should be moved, causes the moving unit to move the recording sheet.

18 Claims, 7 Drawing Sheets

131

| TRAY | REFERENCE POSITION | TRANSPORTATION COUNT |
|---|---|---|
| 2a | 5.5mm | 50 |
| 2b | 3.39mm | 150 |
| 2c | 7.45mm | 350 |

132

| TRAY | BASIS WEIGHT | THRESHOLD(mm) | |
|---|---|---|---|
| | | DISPLACEMENT CORRECTION | OSCILLATION |
| 2a | v1 | 488 | 488 |
| | v2 | 488 | 318 |
| | v3 | 342 | 318 |
| 2b | v1 | 488 | 488 |
| | v2 | 488 | 342 |
| | v3 | 488 | 342 |
| | v4 | 342 | 294 |

RECORDING SHEET MOVING DEVICE, IMAGE FORMING DEVICE, AND RECORDING SHEET MOVING METHOD

CROSS-REFERENCE TO RELATED APPLICATIONS

This application is based on and claims priority under 35 USC 119 from Japanese Patent Application No. 2008-103885 filed on Apr. 11, 2008.

BACKGROUND

1. Technical Field

The present invention relates to a recording sheet moving device, an image forming device, and a recording sheet moving method.

2. Related Art

In an image forming device, it can occur that a recording sheet is transported via a sheet path deviant from an ideal sheet path, because of a production error of a transport unit for transporting the recording sheet or a defect in attachment of the transport unit to the image forming device. In view of this problem, a method of measuring a position of a recording sheet before an image is formed on the recording sheet and correcting displacement of the recording sheet has been proposed.

SUMMARY

An aspect of the present invention provides an recording sheet moving device, including: a moving unit that moves a recording sheet in a direction substantially parallel to a recording surface of the recording sheet and substantially perpendicular to a transport direction in which the recording sheet is transported, the moving unit being provided upstream in the transport direction as compared with an image forming position at which an image is formed on the recording surface of the recording sheet; a recording sheet specifying unit that specifies a length in the transport direction of the recording sheet and a weight per unit area of the recording sheet; a reference position specifying unit that specifies a reference position on the basis of which movement of the recording sheet by the moving unit is determined; a first memory configured to record, for each of plural recording sheets, a threshold for a length in the transport direction in association with a weight per unit area; and a movement control unit that retrieves a threshold for a length in the transport direction on the basis of the weight per unit area specified by the recording sheet specifying unit from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit.

BRIEF DESCRIPTION OF THE DRAWINGS

Exemplary embodiments of the present invention will now be described in detail below with reference to the following figures, wherein.

DETAILED DESCRIPTION

An exemplary embodiment of the present invention will be described with reference to the drawings below.

A. Configuration

A-1. Configuration of Image Forming Device

Figure 1:
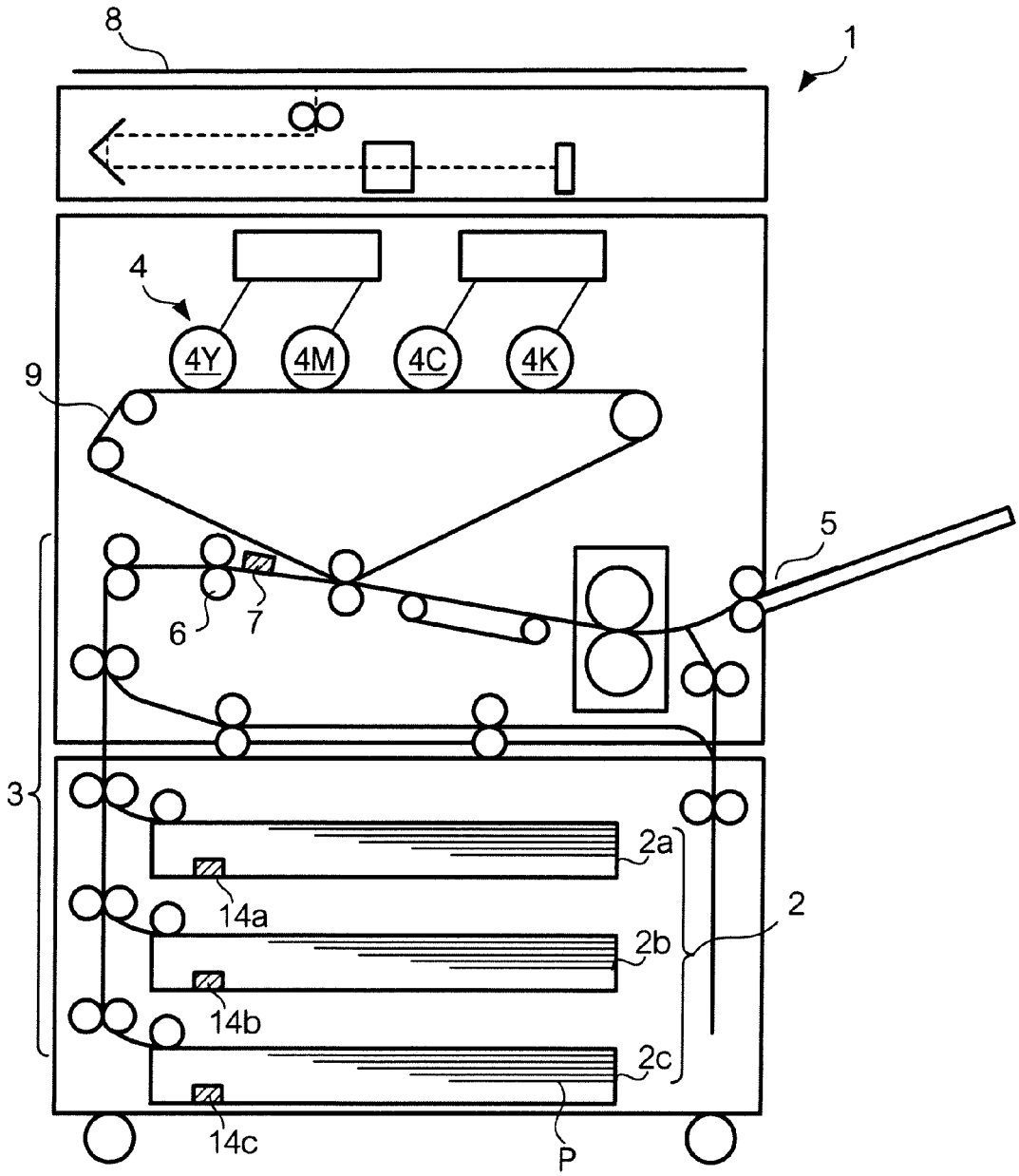
FIG. 1 is a schematic diagram illustrating a configuration of an image forming device.

FIG. 1 is a schematic diagram illustrating a configuration of image forming device 1. Image forming device 1 is a device for forming an image on a recording sheet and outputting the sheet on which the image is recorded. A recording sheet is, for example, a sheet such as plain paper or recycled paper, or a resin sheet such as an OHP sheet. In the present exemplary embodiment, a recording sheet is referred to as "sheet P".

Image forming device 1 has: trays 2*a*, 2*b*, and 2*c* (hereinafter referred to as "tray 2", except where it is necessary to specify otherwise) which are examples of plural sheet storage units for storing sheets P; transport unit 3 which is an example of a unit for transporting sheet P retrieved from tray 2 to an image forming position; image forming units 4Y, 4M, 4C, and 4K (hereinafter referred to as "image forming unit 4", except where it is necessary to specify otherwise) which are examples of a unit for forming a toner image of color of Y, M, C, or K on an image carrier such as a photoreceptor; intermediate belt 9 which is an example of a transfer unit to which a toner image formed by image forming unit 4 is transferred, for transferring the toner image onto sheet P transported by transport unit 3 at an image forming position; and sheet ejecting unit 5 for ejecting sheet P on which a toner image has been transferred. Image forming device 1 also has sheet measuring units 14*a*, 14*b*, and 14*c* (hereinafter referred to as "sheet measuring unit 14", except where it is necessary to specify otherwise) for measuring a physical quantity of sheet P, which are provided in trays 2*a*, 2*b*, and 2*c*, respectively. Sheet measuring unit 14 includes sheet length sensor 141 for measuring the length of sheet P in the transport direction and sheet basis weight sensor 142 for measuring the weight of sheet P per unit area (hereinafter, referred to as "basis weight"). Sheet length sensor 141 may measure the length of sheet P in the transport direction using an optical sensor. Specifically, sheet length sensor 141 may measure the length of sheet P in the transport direction by measuring time when light irradiated from a light source is blocked by sheet P transported by transport unit 3. Sheet basis weight sensor 142 may measure the basis weight of sheet P by measuring the ultrasonic transmission of sheet P (please refer to JP-57-132055).

Image forming device 1 also has registration rollers 6 for transporting sheet P to an image forming position and CIS (Contact Image Sensor) sensor 7 which is an example of a measuring unit for measuring a position of sheet P in a direction parallel to a surface of sheet P and perpendicular to the transport direction. Registration rollers 6 and CIS sensor 7 are provided upstream in the transport direction as compared with an image forming position at which a toner image is transferred onto sheet P. Registration rollers 6 are an example of a sheet moving unit for moving sheet P in a direction parallel to a surface of sheet P and perpendicular to the transport direction. It is to be noted that registration rollers 6 may move sheet P in a direction substantially parallel to a surface of sheet P and substantially perpendicular to the transport direction.

Image forming device 1 also has image reading unit 8 for optically reading an image from a document to generate image data, and a user interface unit (not shown).

It is to be noted that although trays 2*a*, 2*b*, and 2*c* are described as built-in trays in the present exemplary embodiment, they may be external optional trays or bypass trays.

A-2. Functional Configuration of Image Forming Device

Figures 2, 3A, 3B:
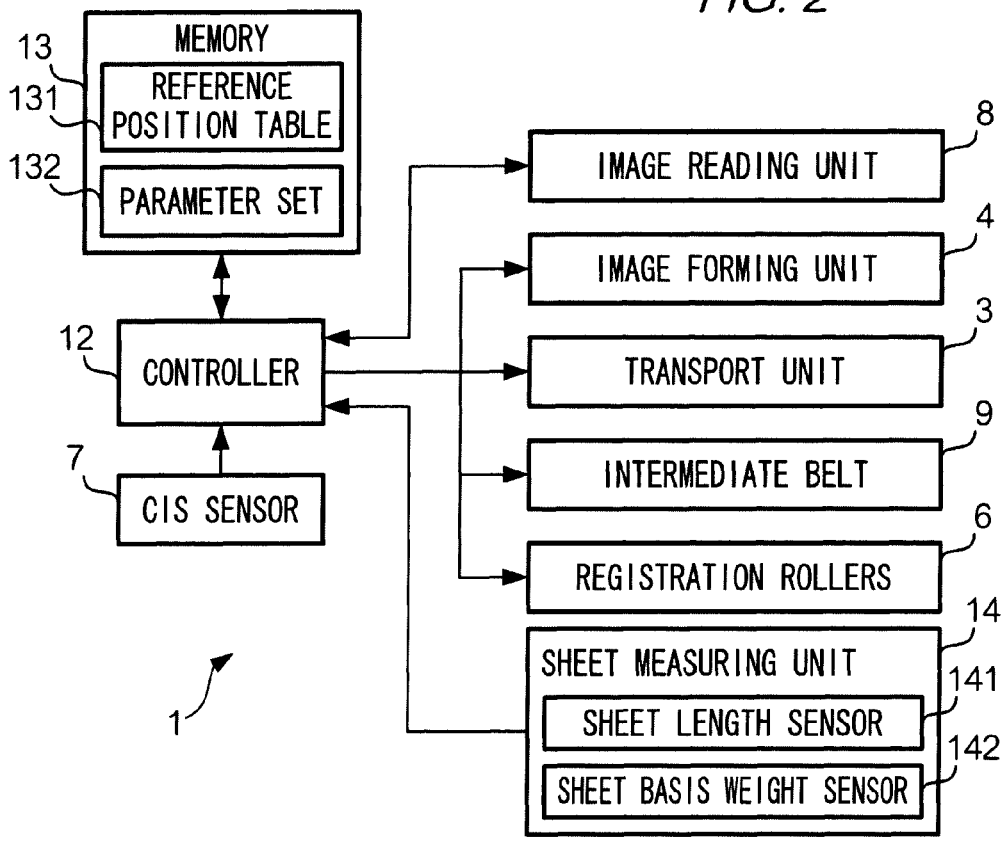
FIG. 2 is a diagram illustrating a functional configuration of an image forming device.
FIG. 3A is a diagram illustrating a reference position table stored in a memory.
FIG. 3B is a diagram illustrating a parameter set stored in a memory.

FIG. 2 is a diagram illustrating a functional configuration of image forming device 1. As shown in the drawing, image forming device 1 has CIS sensor 7, controller 12, memory 13, registration rollers 6, image reading unit 8, transport unit 3, image forming unit 4, and sheet measuring unit 14.

Transport unit 3 retrieves sheet P from tray 2 and transports it to an image forming position at which a toner image is transferred from intermediate belt 9 onto sheet P.

CIS sensor 7 measures a position of sheet P in a direction parallel to a surface of sheet P and perpendicular to the transport direction, transported by transport unit 3, and provides data on the position to controller 12.

Sheet measuring unit 14 measures a physical quantity of sheet P such as the length of sheet P in the transport direction or the basis weight of sheet P, transported by transport unit 3, and provides data on the physical quantity to controller 12.

Memory 13 is a storage device such as a hard disk drive or a flash memory. Memory 13 is an example of a unit for recording reference positions as positions of sheet P in a direction parallel to a surface of sheet P and perpendicular to the transport direction, at which a toner image is transferred from intermediate belt 9 onto sheet P. A reference position is recorded for each tray 2. A reference position is a position of sheet P in a direction parallel to a surface of sheet P and perpendicular to the transport direction, which is a position to which sheet P is likely to be transported by transport unit 3. A reference position is recorded for each tray 2 in reference position table 131, as shown in FIG. 3A. In reference position table 131, the number of sheets P that have been transported by transport unit 3 is recorded for each tray 2 as a "transportation count". A transportation count for each tray 2 is reset (namely, a value of zero is recorded) when image forming device 1 is manufactured, or image forming unit 4 or intermediate belt 9 is replaced. In addition, if new tray 2 is provided in image forming device 1, or tray 2 is replaced, a transportation count for the tray is reset.

Memory 13 also pre-stores parameter set 132 which is a set of parameters required for an operation of controller 12, and computer programs. FIG. 3B shows an example of parameter set 132. Parameter set 132 includes threshold values (unit: mm) for the length of sheet P for each combination of tray 2 and a basis weight of sheet P, which are used to determine whether to apply a displacement correction and/or an oscillation.

The basis weight of a commonly-used sheet is, if expressed in the number of grams per square meter, 60 to 300 grams per square meter. Memory 13 records threshold values for the length of sheet P for each range of basis weight v1, v2, v3, or v4 associated with each tray 2. A basis weight of the ranges v1, v2, v3, and v4 increases in the following order: v1, v2, v3, v4. Each range of basis weights may be set in increments of 10 grams per square meter or 20 grams per square meter. A threshold value is set so that the larger a basis weight is, the smaller a threshold value is. This is because a sheet having a larger amount of basis weight; in other words, a thick sheet is, even if the sheet is short, since it is not able to absorb the stress generated by an oscillation or a displacement correction, likely to be damaged by the stress. Conversely, a sheet having a smaller amount of basis weight; in other words, a thin sheet is, since it is able to absorb the stress generated by an oscillation or a displacement correction, not likely to be damaged by the stress. A threshold value to be used to determine whether to apply an oscillation is set smaller than that to be used to determine whether to apply a displacement correction. This is because a displacement correction, which is an operation for keeping a position of a recording sheet within a range in which image formation can be made, has priority over an oscillation, which is an operation for preventing damage to a transfer unit or a fixing unit resulting from the repeated passages of recording sheets along the same track.

If the basis weight of sheet P retrieved from tray 2*a* is v2, and the length of sheet P is less than 488 mm, a displacement correction is applied. On the other hand, if the basis weight of sheet P retrieved from tray 2*a* is v2, and the length of sheet P is equal to or larger than 488 mm, a displacement correction is not applied. If the basis weight of sheet P retrieved from tray 2*a* is v2, and the length of sheet P is less than 318 mm, an oscillation is applied. On the other hand, if the basis weight of sheet P retrieved from tray 2*a* is v2, and the length of sheet P is equal to or larger than 318 mm, an oscillation is not applied.

Memory 13 also stores, in addition to parameter set 132, other numeric values required for operation of controller 12 such as: values indicating a maximal range within which sheet P can be moved in a direction parallel to a surface of sheet P and perpendicular to the transport direction; values indicating an oscillation width within which sheet P is periodically moved in a direction parallel to a surface of sheet P and perpendicular to the transport direction for the purpose of protecting a transfer unit and a fixing unit; values indicating a sheet position interval which is an interval of sheet positions at which sheet P is located within the oscillation width; and values indicating a transportation count threshold which is the number of sheets P transported until a sheet position is changed. In the present exemplary embodiment, it is assumed that the maximal range is 2 to 10 mm, the oscillation width is 4 mm, the sheet position interval is 0.5 mm, and the transportation count threshold is 100.

Controller 12 has a CPU (Central Processing Unit), a ROM (Read Only Memory), and a RAM (Random Access Memory), which retrieves and executes a computer program stored in memory 13 to control components of image forming device 1. For example, controller 12 retrieves data on a reference position associated with tray 2 from which sheet P is retrieved, from reference position table 131 stored in memory 13, retrieves parameters from among parameter set 132 stored in memory 13, and calculates on the basis of the pieces of data a position of a side edge of sheet P (hereinafter referred to as "sheet position") being transported to an image forming position. Controller 12, when sheet P is located upstream in the transport direction as compared with an image forming position, calculates on the basis of the sheet position and a position measured by CIS sensor 7 a correction amount which indicates a difference between the two positions, to bring sheet P closer to the sheet position. Controller 12 provides registration rollers 6 with an instruction to carry out a correction processing according to the correction amount.

Registration rollers 6 are a pair of rollers, which is provided upstream in the transport direction as compared with an image forming position. Registration rollers 6, while holding sheet P, moves it in a direction parallel to a surface of sheet P and perpendicular to the transport direction according to a correction amount notified from controller 12. The axes of registration rollers 6 are connected to a drive mechanism including a motor and gears. The number of rotations of registration rollers 6, namely a distance sheet P moves, is determined by the number of rotations of the motor.

Image forming unit 4, in accordance with an instruction from controller 12, sets as a position of an edge of a latent image for forming a toner image, a position corresponding to a sheet position calculated by controller 12.

A-3. Configurations of CIS Sensor and Registration Rollers

Figure 4A:
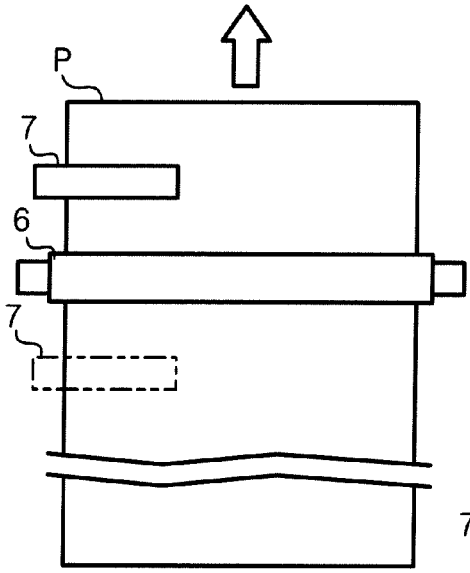
FIGS. 4A and 4B are diagrams illustrating an arrangement of a CIS sensor and a registration roller.
Figure 4B:
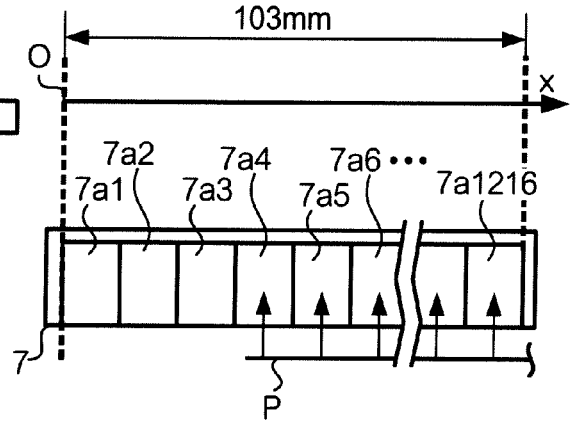

FIGS. 4A and 4B are diagrams illustrating an arrangement of CIS sensor 7 and registration roller 6. FIG. 4A is a diagram illustrating CIS sensor 7 and registration roller 6 as seen from the upper side of FIG. 1. In the drawing, symbol P indicates a surface of sheet P onto which a toner image is transferred, and the arrow indicates the transport direction. FIG. 4B is a diagram illustrating CIS sensor 7 as seen from the upstream side in the transport direction.

As shown in FIG. 4A, CIS sensor 7 and registration rollers 6 are provided upstream in the transport direction as compared with an image forming position at which a toner image is transferred onto sheet P. Registration rollers 6 are provided upstream in the transport direction as compared with CIS sensor 7. CIS sensor 7 is provided so that it covers the left side of sheet P relative to the transport direction. CIS sensor 7 detects a position of a side edge of sheet P. CIS sensor 7 has a surface having a predetermined size for detecting a position of a side edge of sheet P of various sizes, which extends in a direction parallel to a surface of sheet P and perpendicular to the transport direction.

Specifically, CIS sensor 7 has 1,216 light receiving elements 7*a*1 to 7*a*1216 (hereinafter referred to as "light receiving element 7*a*", except where it is necessary to specify otherwise), which are arranged in a direction parallel to a surface of sheet P and perpendicular to the transport direction, as shown in FIG. 4B. Light receiving elements 7*a* are configured to receive light emitted from light sources arranged along light receiving elements 7*a*, such as a LED, and reflected by a subject such as a piece of paper. The resolution of CIS sensor 7 depends on the number of light receiving elements 7*a*. In the present exemplary embodiment, CIS sensor 7 has a maximum detection range of 103 mm (1,216 pixels) in a direction perpendicular to the transport direction (in FIG. 4B, in the right direction) from origin O of FIG. 4B. The resolution of CIS sensor 7 is 300 dpi.

Figure 5:
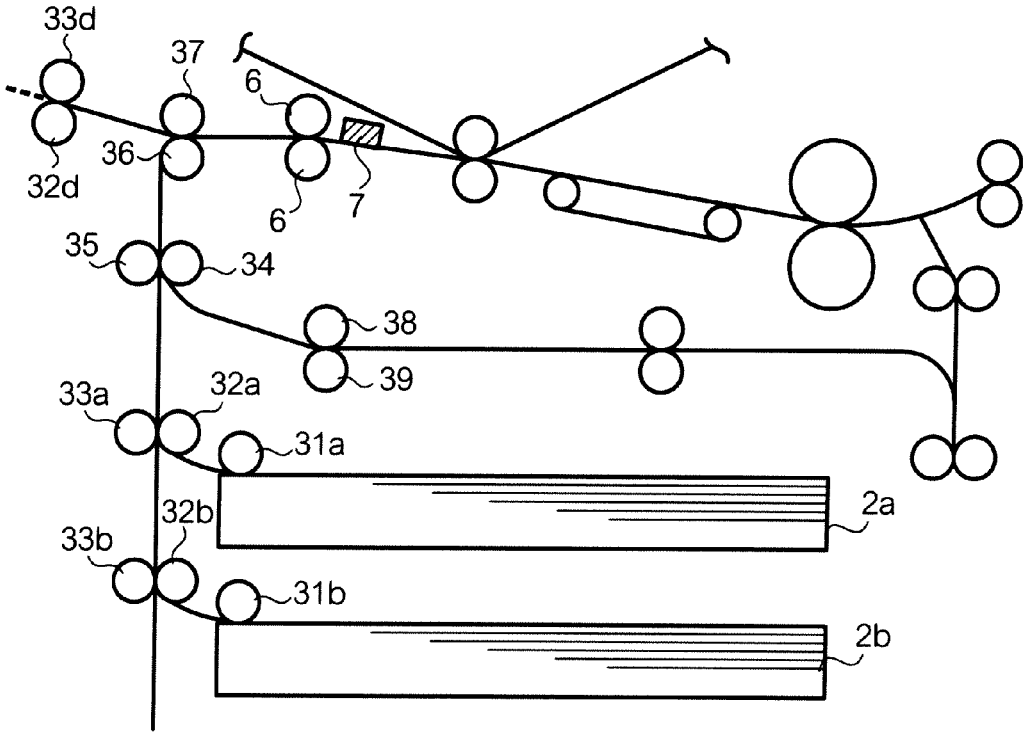
FIG. 5 is a diagram illustrating that the position of a sheet holder whose pressure cannot be relaxed is different for each sheet path.

When sheet P is held by registration rollers 6 to move it, the sheet can be simultaneously held by a sheet holder whose pressure cannot be relaxed because of its structure, such as a retard roller for preventing double feeding. In that case, the front side (the downstream side in the transport direction of FIG. 4A) of sheet P is held by registration rollers 6, and the back side (the upstream side in the transport direction of FIG. 4A) of sheet P is held by a sheet holder. FIG. 5 is a diagram illustrating that there is a sheet path for each tray 2, and that the position of a sheet holder whose pressure cannot be relaxed is different for each sheet path. As shown in the drawing, sheet P stored in tray 2*a* is retrieved by roller 31*a*, and held and transported by rollers 32*a* and 33*a* to the space between rollers 34 and 35. On the other hand, sheet P stored in tray 2*b* is retrieved by roller 31*b*, and held and transported by rollers 32*b* and 33*b* to the space between rollers 34 and 35. After being transported to the space between rollers 34 and 35, sheet P is transported to registration rollers 6 through the interval between rollers 36 and 37. Rollers 34, 35, 36, and 37 are sheet holders whose pressure can be relaxed, and if sheet P is transported from tray 2*a*, rollers 32*a* and 33*a* are sheet holders whose pressure cannot be relaxed, and if sheet P is transported from tray 2*b*, rollers 32*b* and 33*b* are sheet holders whose pressure cannot be relaxed. If sheet P retrieved from tray 2*a* is held by registration rollers 6 and is simultaneously held by a sheet holder whose pressure cannot be relaxed, the sheet has a length of the sheet path extending from roller 32*a* to registration rollers 6 along rollers 34 and 36. On the other hand, if sheet P retrieved from tray 2*b* is held by registration rollers 6 and is simultaneously held by a sheet holder whose pressure cannot be relaxed, the sheet has a length of the sheet path extending from roller 32*b* to registration rollers 6 along rollers 32*a*, 34 and 36. Namely, the length of sheet P which is to be moved by registration rollers 6 while the back side of the sheet is held by a sheet holder whose pressure cannot be relaxed is different for each tray 2. If sheet P is moved by registration rollers 6 over a long distance while the back side of the sheet is held, the sheet undergoes deformation such as distortion or deflection, as described above; accordingly, an image is not likely to be properly formed on the sheet. Therefore, it is preferable that a distance by which sheet P is moved be as short as possible.

B. Operation

B-1. Operation of Calculating Reference Position

As described above, a reference position is recorded in memory 13 for each tray 2. Calculating and recording of a reference position for each tray 2 may be performed by controller 12 before image forming device 1 is shipped.

Figure 6:
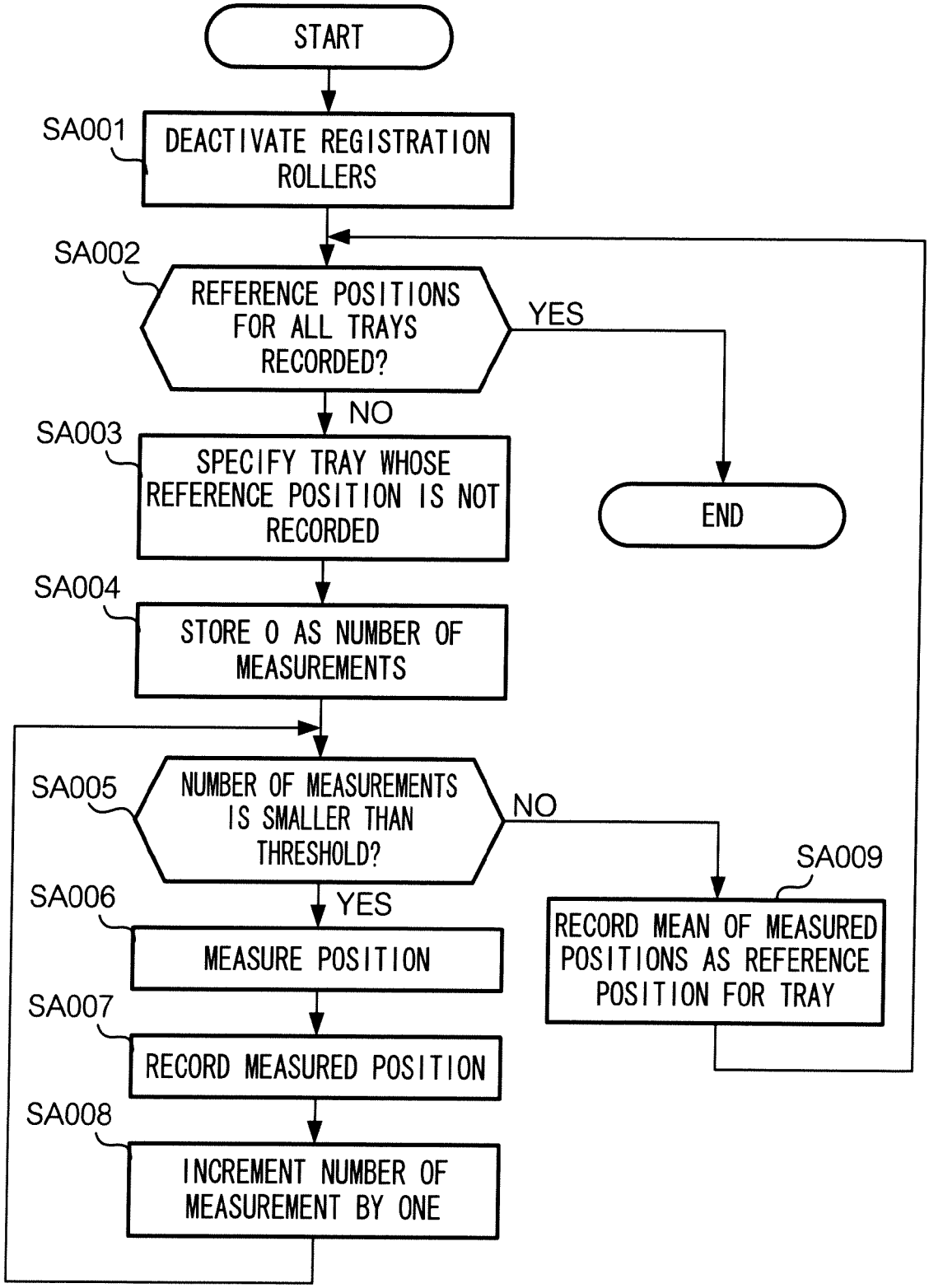
FIG. 6 is a flowchart illustrating an operation of calculating a reference position.

FIG. 6 is a flowchart illustrating an operation of calculating a reference position.

At the start of an operation, controller 12 stops registration rollers 6 from moving in a direction parallel to a surface of sheet P and perpendicular to the transport direction so that sheet P does not move in the direction parallel to a surface of sheet P and perpendicular to the transport direction (step SA001). Subsequently, controller 12 determines whether reference positions for all trays 2 are recorded in memory 13 (step SA002). If it is determined that reference positions for all trays 2 are recorded (step SA002; YES), controller 12 ends the operation of calculating a reference position.

On the other hand, if it is determined that reference positions for all trays 2 are not recorded (step SA002; NO), controller 12 identifies tray 2 for which a reference position is not recorded (step SA003), and stores a value of "0" as the number of measurements for calculating a reference position (step SA004). Controller 12 compares the number of measurements and a threshold value pre-stored in memory 13 to determine whether the number of measurements is smaller than the threshold value (step SA005). If it is determined that the number of measurements is smaller than the threshold value (step SA005; YES), controller 12 causes transport unit 3 to retrieve sheet P from identified tray 2 and transport it, and causes CIS sensor 7 to measure a position of sheet P in a direction parallel to a surface of sheet P and perpendicular to the transport direction (step SA006). Controller 12 records the measured position in memory 13 (step SA007), and increments the number of measurements by one (step SA008).

Controller 12 repeats the operations of steps SA005 to SA008, and if the number of measurements reaches the threshold value (step SA005; NO), controller 12 calculates an arithmetical mean of the measured positions recorded in memory 13, and records the arithmetical mean as a reference position for identified tray 2 (step SA009). For example, if the threshold value is 3, and the number of measurements is 0, 1, or 2 at step SA005, controller 12 causes CIS sensor 7 to measure a position of sheet P (step SA006), and if the number of measurements reaches 3, controller 12 calculates an arithmetical mean of measured positions. Namely, controller 12 causes CIS sensor 7 to measure a position of sheet P the number of times indicated by the threshold value.

If when a reference position for tray 2*a* is calculated, sheet P is transported three times while registration rollers 6 are prevented from moving sheet P, and three values of 5.2 mm, 5.8 mm, and 5.5 mm are recorded as measured positions, an arithmetical mean of 5.5 mm is recorded in memory 13 as a reference position for tray 2*a*, as shown in FIG. 3A. A measured position is expressed by a distance from origin O shown in FIG. 4B in a direction perpendicular to the transport direction (in FIG. 4B, in the right direction), which is determined by a position of a boundary of light receiving element 7*a* that has received reflected light and light receiving element 7*a* that has not received reflected light.

A reference position is expressed by an arithmetical mean of positions measured by CIS sensor 7 when sheets P are actually retrieved from tray 2 and transported by transport unit 3; accordingly, a position of sheet P being transported by transport unit 3 is highly likely to be close to the reference position. It is to be noted that a method of calculating a reference position may be, instead of the method employed in the present exemplary embodiment of calculating the mean of values measured plural times, a method of calculating the mean of measured values after removal of the largest value and the smallest value or a method of a method of calculating the mean of measured values after removal of abnormal values.

After a reference position for identified tray 2 is recorded, controller 12 performs the operation of step SA002.

B-2. Pre-Image-Forming Operation

Figure 7:
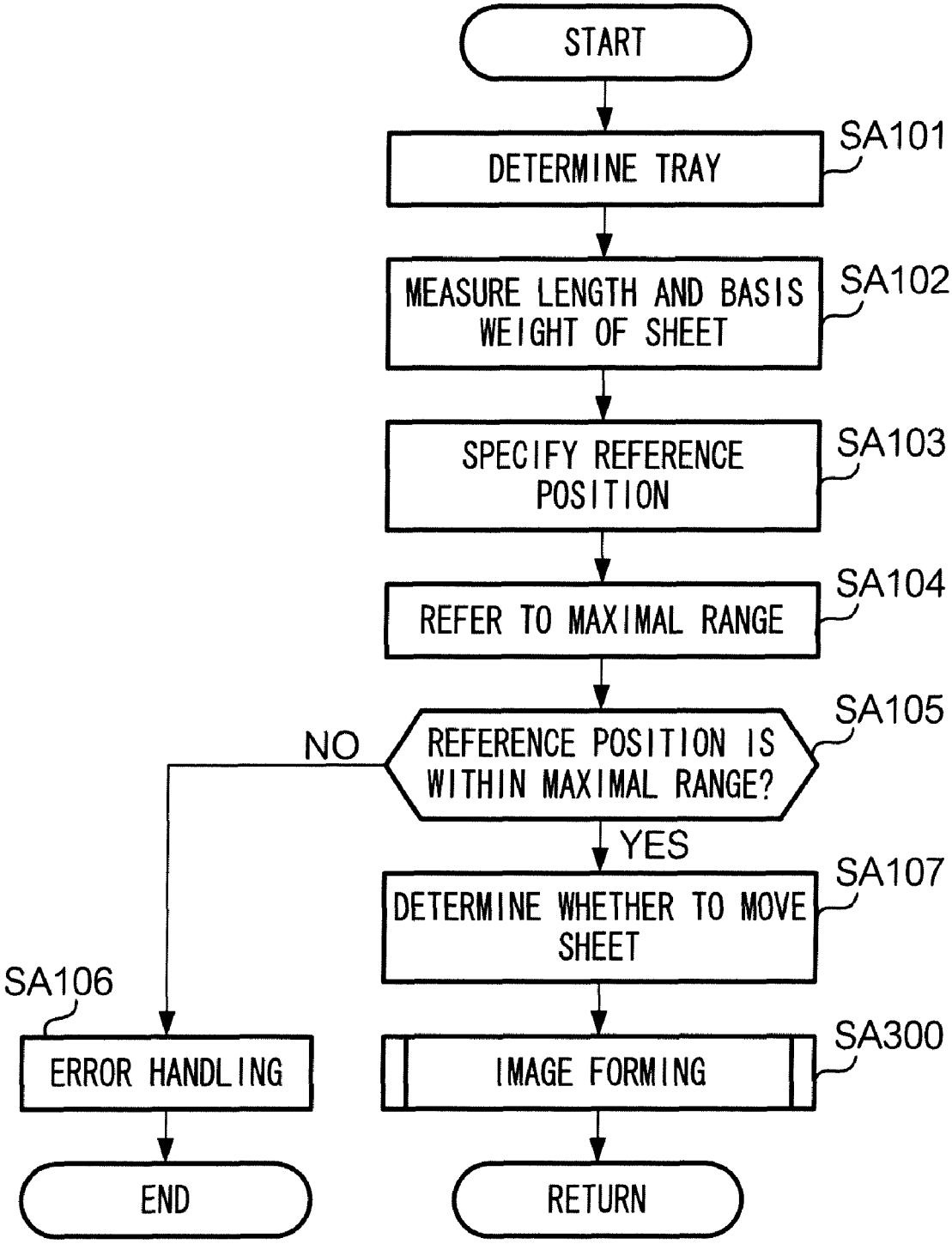
FIG. 7 is a flowchart illustrating a pre-image-forming operation.

FIG. 7 is a flowchart illustrating a pre-image-forming operation. As shown in the drawing, if an instruction is received from a user to form an image, controller 12 determines tray 2 from which sheet P is to be retrieved (step SA101). Subsequently, controller 12 causes sheet measuring unit 14 to measure the length and the basis weight of sheet P (step SA102), and retrieves data on a reference position associated with tray 2 determined at step SA101 from reference position table 131 stored in memory 13 (step SA103). Subsequently, controller 12 retrieves data on a maximal range from memory 13 (step SA104), and determines whether the reference position is with in the maximal range (step SA105). If it is determined that the reference position is not within the maximal range (step SA105; NO), controller 12 performs a predetermined error handling and ends the pre-image-forming operation (step SA106). A case in which the reference position is not within the maximal range is, for example, a case in which the maximal range is 2 to 10 mm while the reference position is 1.5 mm. The predetermined error handling is, for example, displaying of an alert message on a display unit (not shown). If it is determined that the reference position is within the maximal range (step SA105; YES), controller 12 retrieves a threshold value for the length of sheet P associated with a combination of tray 2 from which sheet P is to be retrieved and the basis weight of sheet P, from among parameter set 132 stored in memory 13, to determine whether to apply a displacement correction and/or an oscillation (step SA107). For example, if tray 2 determined at step SA101 is tray 2*b*, and a basis weight measured by sheet basis weight sensor 142 of sheet measuring unit 14 is v3, a threshold value for a displacement correction is 488 mm, and a threshold value for an oscillation is 342 mm. In this case, if the length of sheet P measured by sheet length sensor 141 of sheet measuring unit 14 is 400 mm, which is smaller than the threshold value for a displacement correction, but larger than the threshold value for an oscillation, a displacement correction is applied, but an oscillation is not applied. In this case, a reference position is used as a sheet position to which sheet P is moved, and regardless of a transportation count, sheet P is moved to a reference position.

Figure 8A:
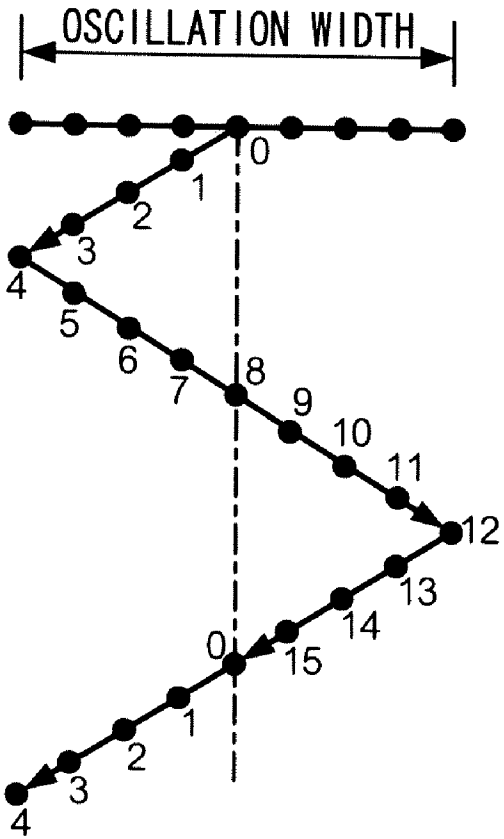
FIGS. 8A to 8C are diagrams illustrating a pattern of sheet positions arranged within an oscillation range.

Alternatively, if the length of sheet P measured by sheet length sensor 141 of sheet measuring unit 14 is 210 mm, which is smaller than the threshold value for a displacement correction and the threshold value for an oscillation, a displacement correction and an oscillation are applied. Controller 12 retrieves a value of a reference position, 3.39 mm, associated with tray 2*b* from reference position table 131 stored in memory 13, retrieves a value of an oscillation width, 4 mm, from memory 13, and determines an oscillation range which has the oscillation width having the reference position at the center. Controller 12 also retrieves a value of a sheet position interval, 0.5 mm, from memory 13, and calculates sheet positions arranged in the oscillation range at regular intervals. Controller 12 also determines the order of sheet positions according to a predetermined algorithm. FIG. 8A is a diagram illustrating an order of sheet positions at which sheet P is located in an oscillation range.

Subsequently, controller 12 performs an image forming operation (step SA300).

B-3. Image Forming Operation

Figure 9:
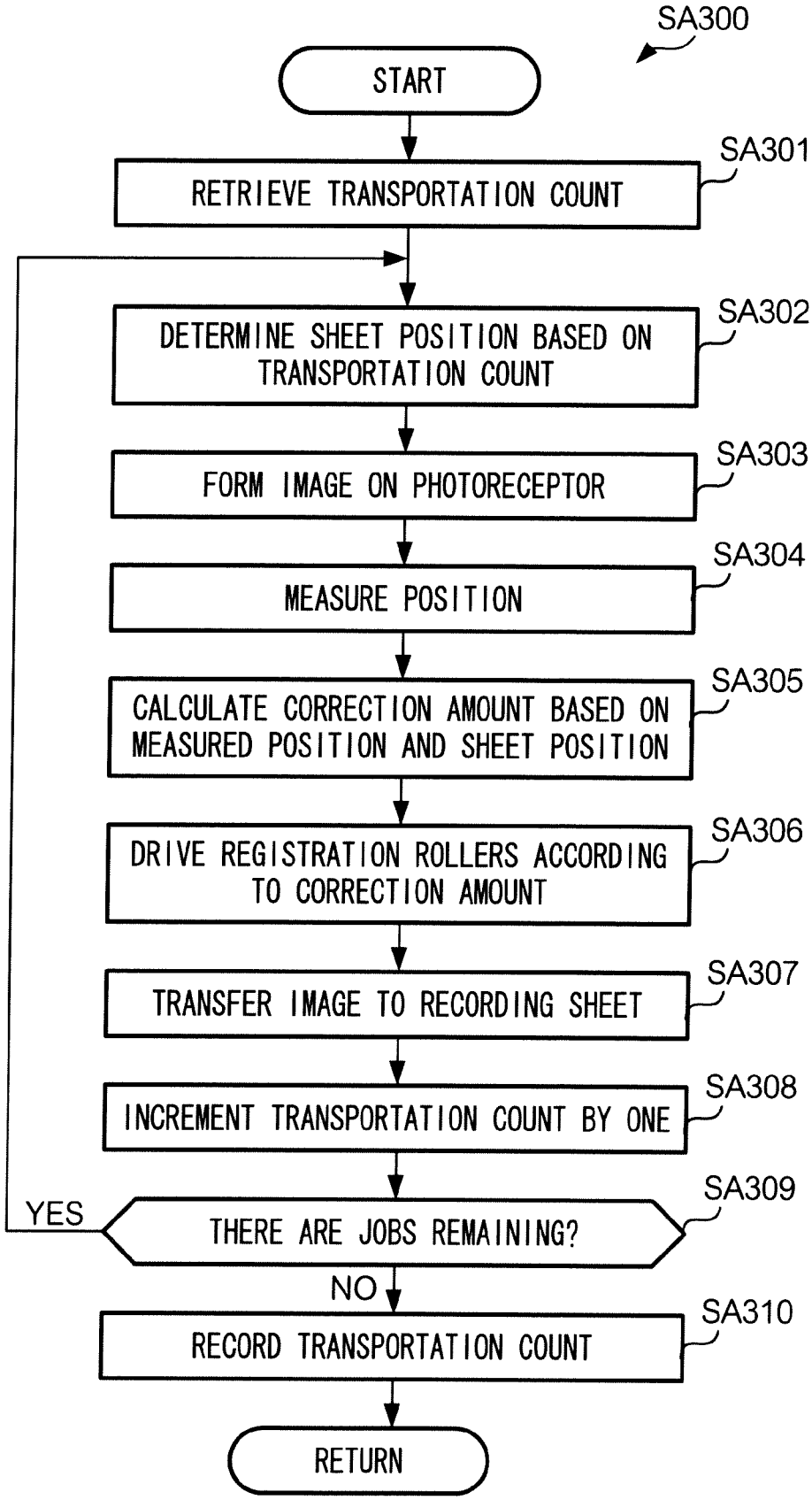
FIG. 9 is a flowchart illustrating an operation of forming an image.

FIG. 9 is a flowchart illustrating an operation of forming an image. At the start of the operation, controller 12 retrieves a transportation count, which indicates a number of sheets P that have been transported, from reference position table 131 stored in memory 13 (step SA301), and determines a sheet position on the basis of the transportation count (step SA302). Specifically, controller 12 divides the transportation count by a transportation count threshold recorded in memory 13, and specifies a sheet position associated with a number indicated by the obtained quotient. Assignment of numbers to sheet positions is made by controller 12 according to the order of the sheet positions, as shown in FIG. 8A, at step SA107 discussed above. For example, if tray 2*a* of FIG. 3A is used, a transportation count is 50 and a transportation count threshold is 100; accordingly, the quotient is 0. In this case, a reference position for tray 2*a*, 5.5 mm, is selected as a sheet position. The sheet position is not changed until the quotient changes from 0 to 1. In other words, until a transportation count reaches 100, the reference position is used as a sheet position. Alternatively, if tray 2*b* is used, a transportation count is 150; accordingly, the quotient is 1. In this case, a sheet position, 2.89 mm, which is a sheet position being lower than a reference position for tray 2*b*, 3.39 mm, by one notch, is selected. In summary, if a recording sheet is transported to a sheet position a number of times indicated by a transportation count threshold, the sheet position is changed, and thereafter a recording sheet is transported to a new sheet position.

Subsequently, controller 12 causes image forming unit 4 to form a toner image on a photoreceptor at a position corresponding to a sheet position (step SA303), causes transport unit 3 to retrieve sheet P from tray 2 determined at step SA 101 and transport sheet P, and causes CIS sensor 7 to measure a position of sheet P in a direction parallel to a surface of sheet P and perpendicular to the transport direction (step SA304). Controller 12 calculates on the basis of the measured position and the sheet position, a correction amount which indicates a difference between the two positions (step SA305), and causes registration rollers 6 to rotate according to the correction amount, to move sheet P (step SA306). For example, if a sheet position is 5.5 mm, and a measured position is 4.5 mm, the correction amount is +1.0 mm. In this case, registration rollers 6 moves sheet P by +1.0 mm from origin O shown in FIG. 4B in the direction of x-axis, while holding sheet P, so that the position of the left edge of sheet P comes closer to the sheet position.

The toner image formed on the photoreceptor of image forming unit 4 is transferred to intermediate belt 9, and then transferred from intermediate belt 9 onto sheet P transported by transport unit 3 at an image forming position (step SA307). Subsequently, controller 12 increments a transportation count by one (step SA308), and determines whether there are jobs remaining (step SA309). If it is determined that there are jobs remaining (step SA309; YES), controller 12 performs the operation of step SA302. On the other hand, if it is determined that there is no job remaining (step SA309; NO), controller 12 records the transportation count in reference position table 131 stored in memory 13 (step SA310), and returns to the calling routine from the present routine.

C. Modifications

The exemplary embodiment discussed above may be modified as described below. The modifications may be combined with each other.

C-1. In the above exemplary embodiment, conditions for starting the operation of calculating a reference position may be set. For example, the operation may be started when an instruction from a user to start the operation using an operation unit (not shown) is received. Alternatively, the operation may be automatically started when it is detected that tray 2 is attached to image forming device 1. When tray 2 is replaced, or new tray 2 is provided, it is necessary to calculate a reference position. Attachment of tray 2 may be detected by a sensor provided at image forming device 1, which is provided a push-button switch having an elastic member. The push-button switch may be configured so that when tray 2 is not attached, contact points of the switch are separated by the repulsion of an elastic member; as a result, a predetermined signal is not sent to controller 12, and on the other hand, when tray 2 is attached, contact points are brought into contact with each other by the pressure of tray 2 being pushed; as a result, a predetermined signal is sent to controller 12. On receipt of the signal, controller 12 starts the operation of calculating a reference position.

C-2. In the above exemplary embodiment, considering that a position of sheet P differs from one tray to another, a reference position of sheet P is recorded for each tray 2, and a position of sheet P is corrected according to the difference between the reference position and a measured position. The reason that a position of sheet P differs from one tray to another is either or both that a position at which a tray is attached differs from one tray to another, and that a sheet path via which a sheet is transported differs from one tray to another.

The term "sheet path" is a concept that can be considered to include a tray in the broad sense; accordingly, the above reasons are summarized as follows. A sheet path via which a sheet is transported differs from one tray to another. Considering this, the present invention may be embodied as a recording sheet moving device including: a moving unit that moves a recording sheet in a direction substantially parallel to a recording surface of the recording sheet and substantially perpendicular to a transport direction in which the recording sheet is transported, the moving unit being provided upstream in the transport direction as compared with an image forming position at which an image is formed on the recording surface of the recording sheet; a recording sheet specifying unit that specifies a length in the transport direction of the recording sheet and a weight per unit area of the recording sheet; a reference position specifying unit that specifies a reference position on the basis of which movement of the recording sheet by the moving unit is determined; a transport unit that transports the recording sheet to the image forming position via one of a plurality of sheet paths; a first memory configured to record, for each of plural recording sheets, a threshold for a length in the transport direction in association with a combination of a weight per unit area and one of the plurality of sheet paths; and a movement control unit that retrieves a threshold for a length in the transport direction on the basis of a combination of the weight per unit area specified by the recording sheet specifying unit and the sheet path via which the recording sheet is transported by the transport unit, from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit. In the above exemplary embodiment, transport unit 3 is an example of the transport unit of the recording sheet moving device, memory 13 is an example of the first memory, and registration rollers 6 are an example of the moving unit.

C-3. A sheet path for face printing and a sheet path for back-surface printing, which are used when double face printing is carried out, may be distinguished. In double face printing, a recording sheet is, after an image is formed on one side of the sheet at an image forming position, returned by a reversal mechanism to the image forming position; accordingly, a sheet path and the distance thereof are different in cases in which an image is formed on the front surface of a recording sheet and in which an image is formed on the back surface of the recording sheet. Considering this, in the above exemplary embodiment, memory 13 may record two reference positions for each tray 2. Specifically, memory 13 may record for each tray 2, a first reference position that is the mean of positions measured when sheet P is transported with its front surface up by transport unit 3, and a second reference position that is the mean of positions measured when sheet P is transported with its back surface up by transport unit 3 after the sheet is returned by a switchback mechanism. If sheet P is transported by transport unit 3 with its front surface up, a first reference position may be retrieved from memory 13, and if sheet P is transported by transport unit 3 with its back surface up after the sheet is returned by a switchback mechanism, a second reference position may be retrieved from memory 13, to be used for displacement correction.

C-4. In the above exemplary embodiment, where registration rollers 6 are provided upstream in the transport direction as compared with CIS sensor 7, CIS sensor 7 may be provided upstream in the transport direction as compared with registration rollers 6, as shown by the dashed line of FIG. 4A.

C-5. In the above exemplary embodiment, where registration rollers 6 move sheet P according to a correction amount which indicates a difference between a sheet position and a position measured by CIS sensor 7 so that the position of the left edge of sheet P comes closer to the sheet position, registration rollers 6 may move sheet P according to an amount calculated on the basis of a correction amount. For example, registration rollers 6 may move sheet P according to an amount obtained by multiplying a correction amount by a predetermined coefficient (e.g., 0.8).

C-6. In the above exemplary embodiment, where controller 12 assigns a number to calculated sheet positions according to the order of the sheet positions, divides a transportation count by a transportation count threshold, and specifies a sheet position associated with a number indicated by the obtained quotient, controller 12 may specify a sheet position using another method. For example, if sheet positions are selected as shown in the pattern of FIG. 8A, in which one cycle includes 16 sheet positions, and a number from 0 to 15 is assigned to the sheet positions, the obtained quotient may be further divided by 16, and a sheet position associated with a number indicated by the obtained residue may be specified.

Figure 8B:
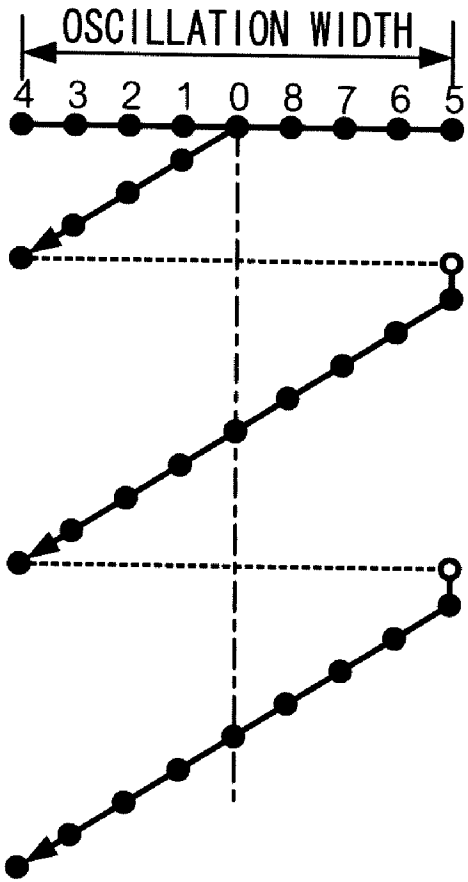
Figure 8C:
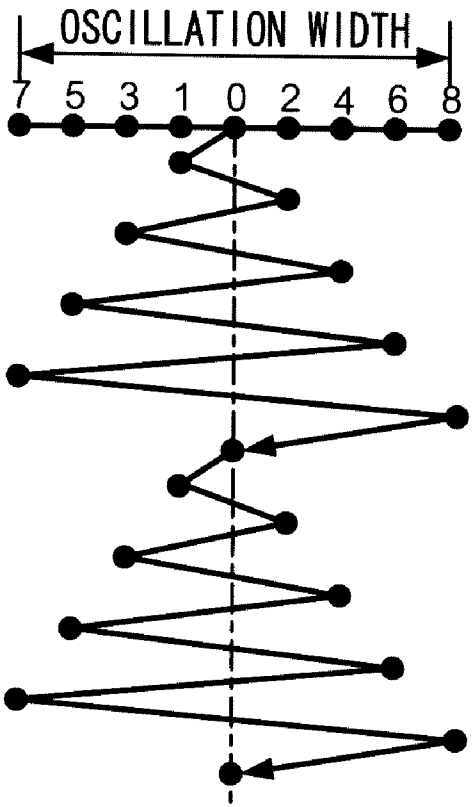

Alternatively, if an oscillation width is 4.0 mm, a sheet position interval is 0.5 mm, and a number from 0 to 8 is assigned to sheet positions as shown in FIG. 8B, the obtained quotient may be further divided by 9, and a sheet position associated with a number indicated by the obtained residue may be specified. As a result, sheet positions having a saw-like pattern shown in FIG. 8B are specified. Alternatively, if a number from 0 to 8 is assigned to sheet positions from side to side from the center as shown in FIG. 8C, sheet positions having a pattern shown in FIG. 8C are specified.

C-7. In the above embodiment, where controller 12 calculates sheet positions so that they are arranged at regular intervals in an oscillation range, the sheet positions do not have to be arranged at regular intervals. For example, controller 12 may calculate sheet positions so that the ratio of each interval of sheet positions is constant. Alternatively, it is possible that a sheet position interval is not set. For example, controller 12 may generate a pseudo random number, and specify a sheet position associated with the generated pseudo random number.

C-8. In the above exemplary embodiment, where a transportation count recorded in reference position table 131 stored in memory 13 is incremented by one each time a sheet is transported from tray 2, controller 12 may change a value to be added as a transportation count depending on the length in the transport direction of a sheet transported from tray 2. Specifically, controller 12, when an A4 sheet is transported from tray 2, may increment a transportation count associated with tray 2 by one, and when an A3 sheet, which is two times longer in the transport direction than an A4 sheet, is transported from tray 2, may increment a transportation count associated with tray 2 by two. Alternatively, in the above exemplary embodiment, instead of a transportation count, a transportation distance which indicates the total length in the transport direction of recording sheets that have been transported from tray 2, may be used. Specifically, if an A4 sheet is transported from tray 2, a value of 210 (mm) may be added, and if an A3 sheet is transported from tray 2, a value of 420 (mm) may be added.

C-9. In the above exemplary embodiment, where threshold values for the length of a sheet are pre-stored in memory 13 as a part of parameter set 132 for each combination of tray 2 and a basis weight of a sheet, to be used to determine whether to apply a displacement correction and/or an oscillation, the threshold values may be set by a user. The parameters may be updated by controller 12 in response to an instruction from a user to update the parameters using an operation unit (not shown).

In the above exemplary embodiment, where the length in the transport direction of a sheet is measured by sheet length sensor 141 of sheet measuring unit 14, and the basis weight of a sheet is measured by sheet basis weight sensor 142 of sheet measuring unit 14, the length and the basis weight of a sheet may be input by a user. A user may input the length and the basis weight of a sheet using an operation unit (not shown) each time s/he instructs image forming device 1 to form an image, and controller 12 may determine whether to apply a displacement correction and/or an oscillation on the basis of the length and the basis weight. Alternatively, a user may pre-set the length and the basis weight of a sheet for each tray 2 using an operation unit in memory 13, and controller 12 may use the data stored in memory 13 and threshold values for the length of a sheet included in parameter set 132, to determine whether to apply a displacement correction and/or an oscillation.

C-10. In the above exemplary embodiment, where threshold values for the length of a sheet are stored in memory 13 as a part of parameter set 132 for each combination of tray 2 and a basis weight of a sheet, to be used to determine whether to apply a displacement correction and/or an oscillation, the threshold values may be associated with only a basis weight of a sheet. Controller 12 may use only a measured basis weight of a sheet and threshold values for the length of a sheet included in parameter set 132, to determine whether to apply a displacement correction and/or an oscillation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording sheet moving device, comprising:

a moving unit that moves a recording sheet in a direction substantially parallel to a recording surface of the recording sheet and substantially perpendicular to a transport direction in which the recording sheet is transported, the moving unit being provided upstream in the transport direction as compared with an image forming position at which an image is formed on the recording surface of the recording sheet;

a recording sheet specifying unit that specifies a length in the transport direction of the recording sheet and a weight per unit area of the recording sheet;

a reference position specifying unit that specifies a reference position on the basis of which movement of the recording sheet by the moving unit is determined;

a first memory configured to record, for each of a plurality of recording sheets, a threshold for a length in the transport direction in association with a weight per unit area; and a movement control unit that retrieves a threshold for a length in the transport direction on the basis of the weight per unit area specified by the recording sheet specifying unit from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit.

2. The recording sheet moving device according to claim 1, further comprising:

a plurality of storage units that house recording sheets; and a transport unit that retrieves the recording sheet from one of the plurality of storage units, and transports the retrieved recording sheet to the image forming position, wherein:

the first memory is configured to record, for each of a plurality of recording sheets, a threshold for a length in the transport direction in association with a combination of a weight per unit area and one of the plurality of storage units; and the movement control unit retrieves a threshold for a length in the transport direction on the basis of a combination of the weight per unit area specified by the recording sheet specifying unit and the storage unit from which the recording sheet is retrieved by the transport unit, from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit.

3. The recording sheet moving device according to claim 1, further comprising a transport unit that transports the recording sheet to the image forming position via one of a plurality of sheet paths, wherein:

the first memory is configured to record, for each of a plurality of recording sheets, a threshold for a length in the transport direction in association with a combination of a weight per unit area and one of the plurality of sheet paths; and the movement control unit retrieves a threshold for a length in the transport direction on the basis of a combination of the weight per unit area specified by the recording sheet specifying unit and the sheet path via which the recording sheet is transported by the transport unit, from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit.

4. The recording sheet moving device according to claim 2, further comprising a second memory configured to record a reference position in association with each one of the plurality of storage units, wherein the reference position specifying unit retrieves a reference position associated with the storage unit from which the recording sheet is retrieved by the transport unit, from the second memory.

5. The recording sheet moving device according to claim 4, further comprising a measuring unit that measures a position of the recording sheet in a direction substantially parallel to the recording surface of the recording sheet and substantially perpendicular to the transport direction, the recording sheet being transported by the transport unit, wherein a reference position to be recorded in the second memory is calculated on the basis of positions of a plurality of recording sheets measured by the measuring unit, the plurality of recording sheets being retrieved from one of the plurality of storage units and transported by the transport unit, while the moving unit is deactivated.

6. The recording sheet moving device according to claim 5, further comprising a detector that detects attachment of one of the plurality of storage units to a predetermined fixing point, wherein if attachment of one of the plurality of storage units is detected by the detector, a reference position is calculated on the basis of positions of a plurality of recording sheets measured by the measuring unit, the plurality of recording sheets being retrieved from the attached storage unit and transported by the transport unit, while the moving unit is deactivated, and the calculated reference position is recorded in the second memory in association with the attached storage unit.

7. The recording sheet moving device according to claim 5, wherein:

the second memory is configured to record a combination of a first reference position to be used when a first recoding surface of the recording sheet is used for image forming and a second reference position to be used when a second recording surface of the recording sheet is used for image forming, in association with each one of the plurality of storage units; and the reference position specifying unit retrieves, when the first recoding surface of the recording sheet is used for image forming, a first reference position associated with the storage unit from which the recording sheet is retrieved by the transport unit, from the second memory, and retrieves, when the second recoding surface of the recording sheet is used for image forming, a second reference position associated with the storage unit from which the recording sheet is retrieved by the transport unit, from the second memory.

8. The recording sheet moving device according to claim 3, further comprising a third memory configured to record a reference position in association with each one of the plurality of sheet paths, wherein the reference position specifying unit retrieves a reference position associated with the sheet path via which the recording sheet is transported by the transport unit, from the third memory.

9. An image forming device, comprising:

the recording sheet moving device according to claim 1;

an image forming unit that forms an image on an image carrier at a position corresponding to a position to which the recording sheet is moved by the movement control unit using the moving unit; and a transfer unit that transfers the image formed on the image carrier by the image forming unit onto the recording surface of the recording sheet that is moved by the movement control unit using the moving unit.

10. The image forming device according to claim 9, further comprising:

a plurality of storage units that house recording sheets; and a transport unit that retrieves the recording sheet from one of the plurality of storage units, and transports the retrieved recording sheet to the image forming position, wherein:

the first memory is configured to record, for each of a plurality of recording sheets, a threshold for a length in the transport direction in association with a combination of a weight per unit area and one of the plurality of storage units; and the movement control unit retrieves a threshold for a length in the transport direction on the basis of a combination of the weight per unit area specified by the recording sheet specifying unit and the storage unit from which the recording sheet is retrieved by the transport unit, from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit.

11. The image forming device according to claim 9, further comprising a transport unit that transports the recording sheet to the image forming position via one of a plurality of sheet paths, wherein:

the first memory is configured to record, for each of a plurality of recording sheets, a threshold for a length in the transport direction in association with a combination of a weight per unit area and one of the plurality of sheet paths; and the movement control unit retrieves a threshold for a length in the transport direction on the basis of a combination of the weight per unit area specified by the recording sheet specifying unit and the sheet path via which the recording sheet is transported by the transport unit, from the first memory, and compares the retrieved threshold for a length in the transport direction and the length in the transport direction specified by the recording sheet specifying unit, to determine whether to cause the moving unit to move the recording sheet, and if it is determined that the recording sheet should be moved, causes the moving unit to move the recording sheet within a range specified on the basis of the reference position specified by the reference position specifying unit.

12. The image forming device according to claim 10, further comprising a second memory configured to record a reference position in association with each one of the plurality of storage units, wherein the reference position specifying unit retrieves a reference position associated with the storage unit from which the recording sheet is retrieved by the transport unit, from the second memory.

13. The image forming device according to claim 12, further comprising a measuring unit that measures a position of the recording sheet in a direction substantially parallel to the recording surface of the recording sheet and substantially perpendicular to the transport direction, the recording sheet being transported by the transport unit, wherein a reference position to be recorded in the second memory is calculated on the basis of positions of a plurality of recording sheets measured by the measuring unit, the plurality of recording sheets being retrieved from one of the plurality of storage units and transported by the transport unit, while the moving unit is deactivated.

14. The image forming device according to claim 13, further comprising a detector that detects attachment of one of the plurality of storage units to a predetermined fixing point, wherein if attachment of one of the plurality of storage units is detected by the detector, a reference position is calculated on the basis of positions of a plurality of recording sheets measured by the measuring unit, the plurality of recording sheets being retrieved from the attached storage unit and transported by the transport unit, while the moving unit is deactivated, and the calculated reference position is recorded in the second memory in association with the attached storage unit.

15. The image forming device according to claim 11, further comprising a third memory configured to record a reference position in association with each one of the plurality of sheet paths, wherein the reference position specifying unit retrieves a reference position associated with the sheet path via which the recording sheet is transported by the transport unit, from the third memory.

16. A recording sheet moving method, comprising:

specifying a length of a recording sheet and a weight per unit area of the recording sheet, the length being a length in a transport direction in which the recording sheet is transported;

specifying a reference position on the basis of which movement of the recording sheet is determined;

specifying a threshold for a length in the transport direction associated with the specified weight per unit area;

comparing the specified threshold for a length in the transport direction and the specified length in the transport direction, to determine whether to move the recording sheet; and if it is determined that the recording sheet should be moved, moving the recording sheet in a direction substantially parallel to a recording surface of the recording sheet and substantially perpendicular to the transport direction within a range specified on the basis of the specified reference position, before the recording sheet reaches an image forming position at which an image is formed on the recording surface of the recording sheet.

17. The recording sheet moving method according to claim 16, further comprising specifying a storage unit from which the recording sheet is retrieved and transported to the image forming position, wherein the specified threshold for a length in the transport direction is a threshold for a length in the transport direction associated with the specified weight per unit area and the specified storage unit.

18. The recording sheet moving method according to claim 16, further comprising specifying a sheet path via which the recording sheet is transported to the image forming position, wherein the specified threshold for a length in the transport direction is a threshold for a length in the transport direction associated with the specified weight per unit area and the specified sheet path.

* * * * *